US010655584B2

(12) United States Patent
Nishizawa et al.

(10) Patent No.: US 10,655,584 B2
(45) Date of Patent: May 19, 2020

(54) GASOLINE DIRECT INJECTION RAIL

(71) Applicant: USUI CO., LTD., Sunto-gun, Shizuoka (JP)

(72) Inventors: Hiroyuki Nishizawa, Shizuoka (JP); Shuji Suzuki, Shizuoka (JP)

(73) Assignee: USUI CO., LTD., Sunto-gun, Shizuoka (JP)

( * ) Notice: Subject to any disclaimer, the term of this patent is extended or adjusted under 35 U.S.C. 154(b) by 0 days.

(21) Appl. No.: 15/559,829

(22) PCT Filed: Feb. 1, 2016

(86) PCT No.: PCT/JP2016/000493
§ 371 (c)(1),
(2) Date: Sep. 20, 2017

(87) PCT Pub. No.: WO2016/166923
PCT Pub. Date: Oct. 20, 2016

(65) Prior Publication Data

US 2018/0051665 A1 Feb. 22, 2018

(30) Foreign Application Priority Data

Apr. 15, 2015 (JP) ..... 2015-083009

(51) Int. Cl.
*F02M 55/02* (2006.01)

(52) U.S. Cl.
CPC ..... *F02M 55/025* (2013.01); *F02M 2200/05* (2013.01); *F02M 2200/8076* (2013.01);
(Continued)

(58) Field of Classification Search
CPC combination set(s) only.
See application file for complete search history.

(56) References Cited

U.S. PATENT DOCUMENTS 5,603,302 A 2/1997 Minagawa et al.
5,845,621 A * 12/1998 Robinson ..... F02M 55/025 123/456
(Continued)

FOREIGN PATENT DOCUMENTS

JP H08-114160 A 5/1996
JP 2003-049741 A 2/2003
(Continued)

OTHER PUBLICATIONS

International Search Report for PCT/JP2016/000493 dated Mar. 1, 2016.

*Primary Examiner* — Phutthiwat Wongwian
*Assistant Examiner* — Arnold Castro
(74) *Attorney, Agent, or Firm* — Yokoi & Co., U.S.A.; Toshiyuki Yokoi

(57) ABSTRACT

To obtain a gasoline direct injection rail that enables plating treatment to be easily and reliably performed on the inside of a rail body and an inlet part, also, that includes an orifice, and that has excellent mechanical properties. In a gasoline direct injection rail comprising a steel rail body 4, an inlet part 6 provided integrally with or separately from a first end 5 of the rail body 4 and comprising therein a communication passage 7 in communication with a fuel passage of the rail body 4, and a plurality of injector holders in communication with the fuel passage, a stainless orifice member 1 formed separately from the rail body 4 is securely disposed in the communication passage 7 of the inlet part 6.

2 Claims, 3 Drawing Sheets

(52) U.S. Cl.
CPC ..... *F02M 2200/9053* (2013.01); *F02M 2200/9076* (2013.01)

(56) References Cited

U.S. PATENT DOCUMENTS

| | | | | |
|---|---|---|---|---|
| 6,488,011 | B1 * | 12/2002 | Frank | F02M 55/025 123/447 |
| 6,752,127 | B2 * | 6/2004 | Mori | F02M 55/005 123/456 |
| 6,901,913 | B1 * | 6/2005 | Tsuchiya | F02M 69/465 123/456 |
| 6,905,002 | B2 * | 6/2005 | Bagga | F02M 55/04 123/456 |
| 2007/0169751 | A1 | 7/2007 | Tominaga et al. | |
| 2013/0001891 | A1 * | 1/2013 | Tower | F02M 55/005 277/591 |

FOREIGN PATENT DOCUMENTS

| | | | |
|---|---|---|---|
| JP | 2007-247641 | A | 9/2007 |
| JP | 2012-097690 | A | 5/2012 |
| JP | 2014-047671 | A | 3/2014 |

* cited by examiner

GASOLINE DIRECT INJECTION RAIL

TECHNICAL FIELD

The present invention relates to a gasoline direct injection rail.

BACKGROUND ART

Direct injection gasoline engines have started to come back into widespread use since 2005 in Europe, and many gasoline direct injection rails in recent years are made of stainless materials that have excellent corrosion resistance. However, gasoline direct injection rails made of stainless materials may result in stress corrosion cracking when placed in a chlorine atmosphere or when a corrosive medium such as chlorine is contained in fuel.

On the other hand, steel materials are available in a wide variety of strengths and are inexpensive, and therefore steel materials attract attention as materials having better mechanical properties and greater cost advantages than stainless materials for higher-pressure systems of the future. Thus, recently, there are increasing demands for gasoline direct injection rails made of steel materials.

Patent Literature 1: JP 2012-97690A

DISCLOSURE OF THE INVENTION

Problems to be Solved by the Invention

However, in the case of using a steel gasoline direct injection rail, the surface needs to be plated to prevent rust and corrosion. An inlet part provided in a gasoline direct injection rail is often given an orifice as shown in Patent Literature 1 to reduce pressure fluctuations resulting from the injections of a fuel pump and an injector. In such a case, because the inner diameter of a commonly used orifice is as small as about 1 to 2 mm, a plating solution when performing plating treatment is unlikely to enter inside, and is also unlikely to come out, through the orifice. Therefore, it is difficult to reliably perform plating treatment on the inner circumferential surface of the orifice and the inner circumferential surface of the rail body.

Accordingly, an object of the present invention is to solve the above-described problem and to obtain a gasoline direct injection rail that enables plating treatment to be easily and reliably performed on the inside of the rail body and the inlet part, that also includes an orifice, and that has excellent mechanical properties.

Means for Solving the Problem

The present invention has solved the above-described problem, and is a gasoline direct injection rail comprising:

a steel rail body;

an inlet part provided integrally with or separately from a first end of the rail body and comprising therein a communication passage in communication with a fuel passage of the rail body; and a plurality of injector holders in communication with the fuel passage, wherein a stainless orifice member formed separately from the rail body is securely disposed in the communication passage of the inlet part.

The orifice member may be screw-fixed to the communication passage of the inlet part. Screw-fixing the orifice member to the inlet part makes it possible to firmly fix the orifice member to the inlet part. Unlike in the case of merely fixing the orifice member to the inlet part by insertion, it is not necessary to precisely adjust the dimensions of the outer diameter of the orifice member and the inner diameter of the inlet part, it is easy to position the orifice member relative to the inlet part, and it is thus easy to securely dispose the orifice member in the inlet part. Furthermore, in comparison to the case where the orifice member is fixed to the inlet part with an adhesive, there is no concern of dirt derived from the adhesive and, moreover, the problem of contamination between the adhesive and fuel does not arise.

Effects of the Invention

As described above, in the present invention, the stainless orifice member that is formed separately from the inlet part is screw-fixed to the communication passage of the inlet part provided in the steel rail body. Therefore, performing plating treatment on the rail body provided with the inlet part before securely disposing the orifice member in the inlet part makes it possible to cause a plating solution to easily flow into and flow out of the inside of the inlet part and the rail body because the orifice is not present inside the inlet part and the rail body, and makes it possible to easily perform plating treatment. Since the orifice member is made of a stainless material, it is not necessary to perform plating treatment, and therefore the problem of conventional art concerning plating treatment on a small-diameter orifice does not arise. Since the rail body is made of steel, products can be obtained that are available in a wide variety of strengths and have better mechanical properties than stainless materials for high-pressure systems of the future.

MODES FOR CARRYING OUT THE INVENTION

Embodiment 1

Figure 1:
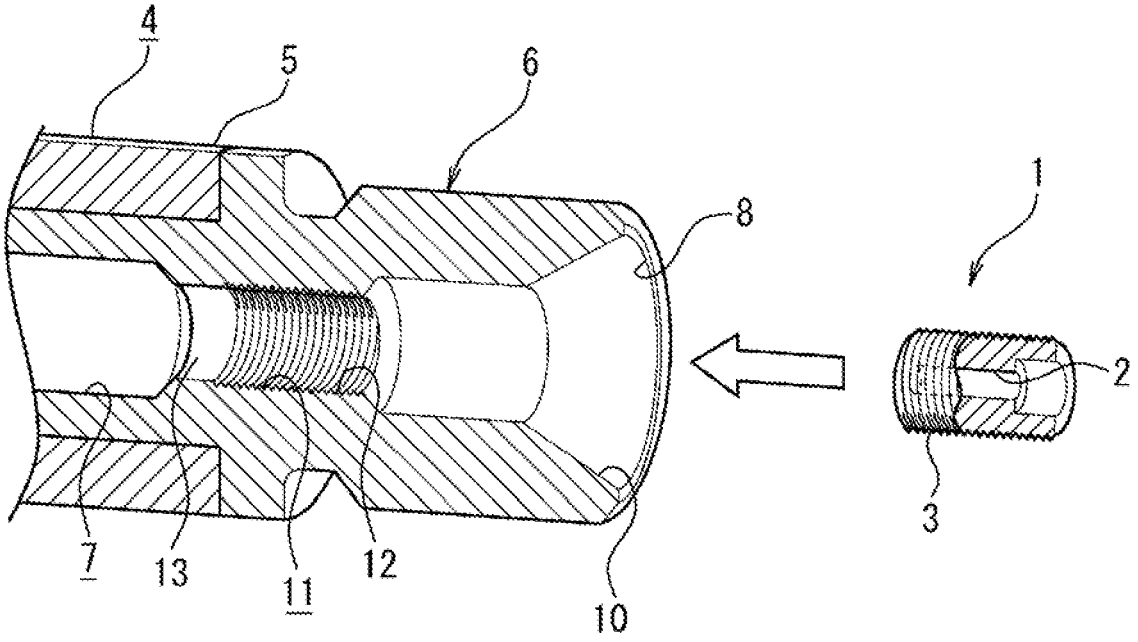
FIG. 1 is a partially enlarged cross-sectional view of Embodiment 1 before an orifice member is attached to an inlet part.

Embodiment 1 of the present invention will now be described in reference to FIGS. 1 and 2 where (1) is an orifice member and is formed of a stainless material. By forming the orifice member (1) from a stainless material, it is not necessity to perform plating treatment for preventing rust and corrosion. The orifice member (1) is formed in a cylindrical shape and is provided with an orifice (2) in the length direction, and the outer circumferential surface thereof has an outer circumferential thread (3) as shown in FIG. 1.

On the other hand, in a rail body (4) of the gasoline direct injection rail, an inlet part (6) that is formed separately from the rail body (4) is securely disposed at a first end (5) thereof. In this embodiment, the inlet part (6) is formed separately from the rail body (4) and is securely disposed at the first end (5) of the rail body (4) as described above, but the inlet part (6) may be formed integrally with the rail body (4) in another embodiment. The rail body (4) and the inlet part (6) are made of steel. A plurality of injector holders (not shown) that are in communication with the fuel passage of the rail body (4) are disposed so as to be connected to the rail body (4) of the present embodiment at equal intervals in the length direction.

Figure 2:
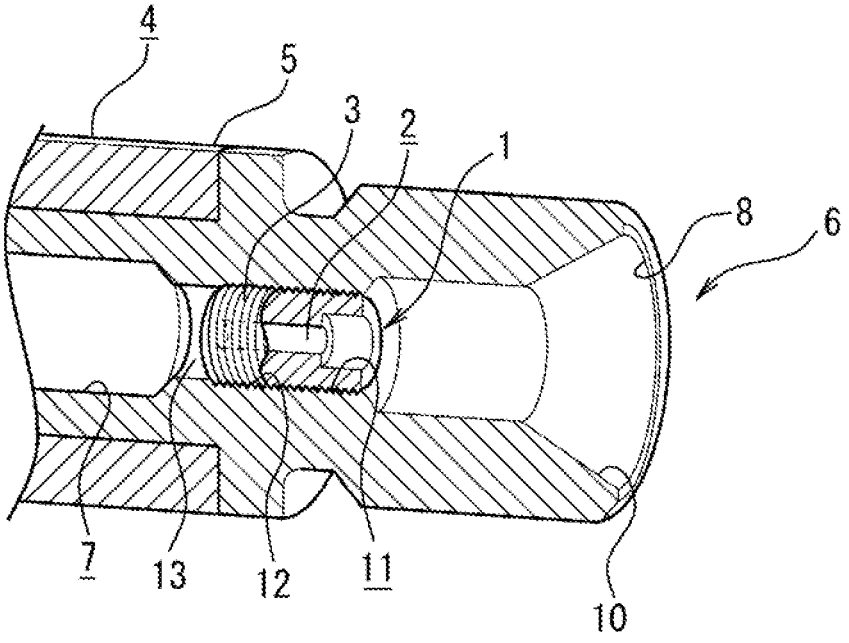
FIG. 2 is a partially enlarged cross-sectional view of Embodiment 1 after an orifice member is attached to an inlet part.

A communication passage (7) is provided in the inlet part (6), and by attaching the inlet part (6) to the rail body (4) as shown in FIG. 1, a state is reached where the communication passage (7) is in communication with the fuel passage (not shown) of the rail body (4). On the opening (8) side of the communication passage (7) of the inlet part (6), a tapered part (10) is formed that is continuous with the communication passage (7) and has a larger diameter on the opening (8) side and a smaller diameter on the side opposite the opening part (8). The communication passage (7) has an attachment hole (11) for attachment of the orifice member (1). The inner circumferential surface of the attachment hole (11) has an inner circumferential thread (12) that can be screw-fitted to the outer circumferential thread (3) of the orifice member (1).

Since the rail body (4) and the inlet part (6) are made of steel, it is necessary to perform plating treatment. Accordingly, before screw-fixing the orifice member (1) to the inlet part (6), plating treatment is performed on the rail body (4) to which the inlet part (6) has been attached. At this time, unlike in conventional products, no orifice is provided in the inlet part (6) of the rail body (4), and it is thus possible to cause a plating solution to reliably flow into and flow out of the rail body (4) and the inlet part (6). Therefore, it is possible to easily and reliably perform plating treatment on the inner circumferences of the rail body (4) and the inlet part (6).

Then, the orifice member (1) is screw-fixed to the attachment part of the inlet part (6) on which plating treatment has been performed as described above. Screw-fixing the orifice member (1) to the inlet part (6) in this way makes it possible to firmly fix the orifice member (1) to the inlet part (6). Unlike in the case of fixing the orifice member (1) to the inlet part (6) by insertion, it is not necessary to precisely adjust the dimensions of the outer diameter of the orifice member (1) and the inner diameter of the inlet part (6), it is easy to position the orifice member (1) relative to the inlet part (6), and it is thus easy to securely dispose the orifice member (1) in the inlet part (6). Furthermore, in comparison to the case where the orifice member (1) is fixed to the inlet part (6) with an adhesive, there is no concern of dirt derived from the adhesive and, moreover, the problem of contamination between the adhesive and fuel does not arise.

Figure 3:
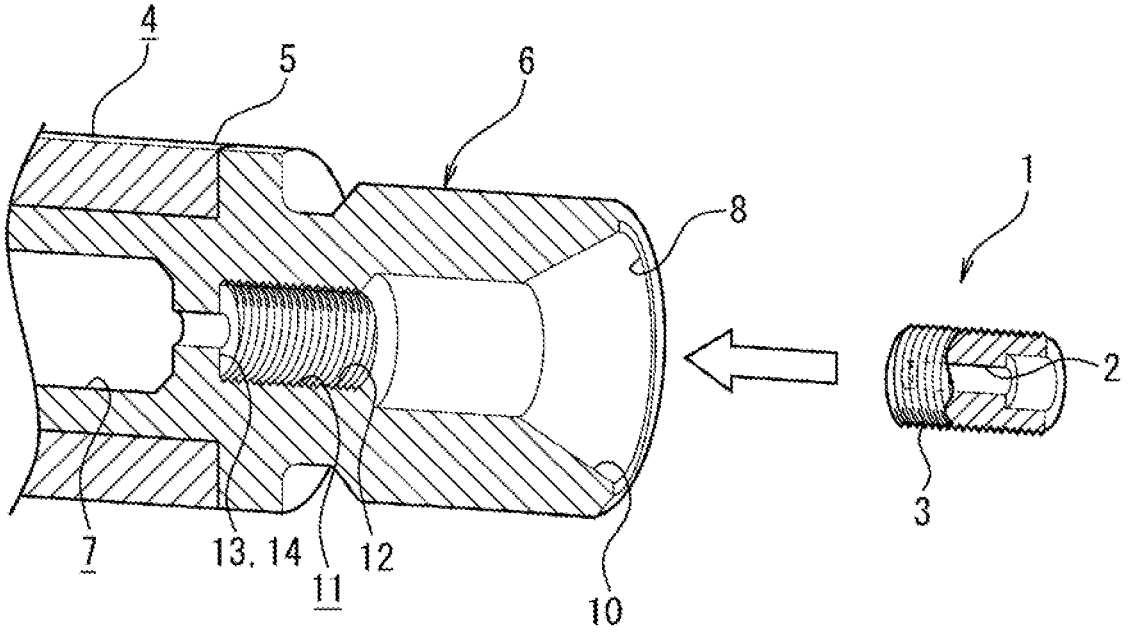
FIG. 3 is a partially enlarged cross-sectional view of another embodiment before an orifice member is attached to an inlet part.
Figure 4:
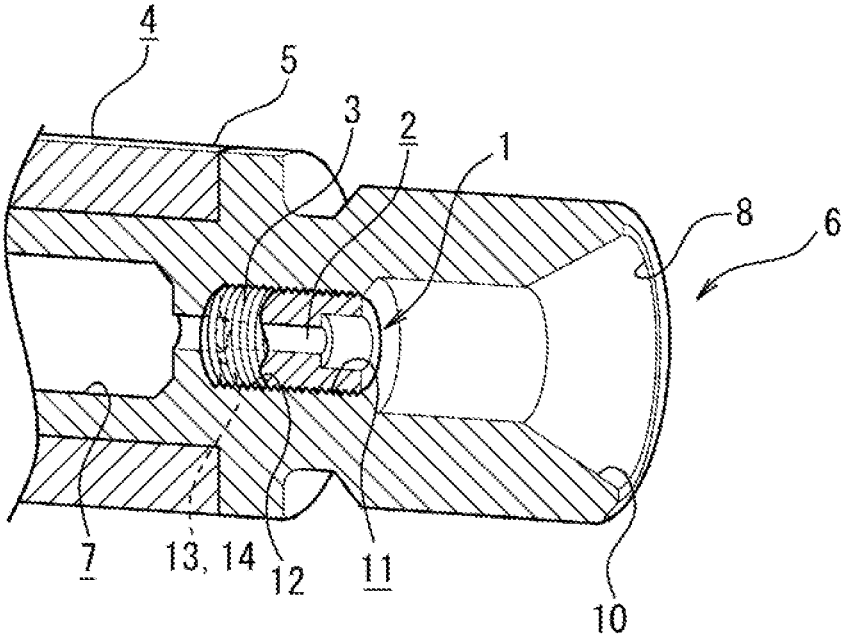
FIG. 4 is a partially enlarged cross-sectional view of another embodiment after an orifice member is attached to an inlet part.
Figure 5:
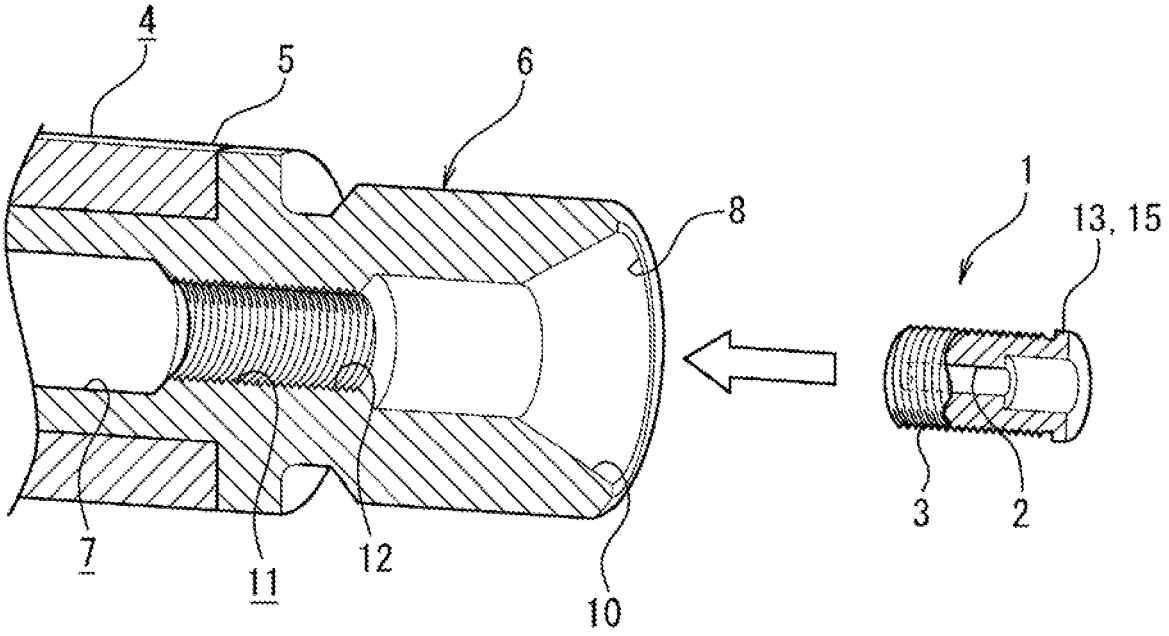
FIG. 5 is a partially enlarged cross-sectional view of another embodiment before an orifice member is attached to an inlet part.
Figure 6:
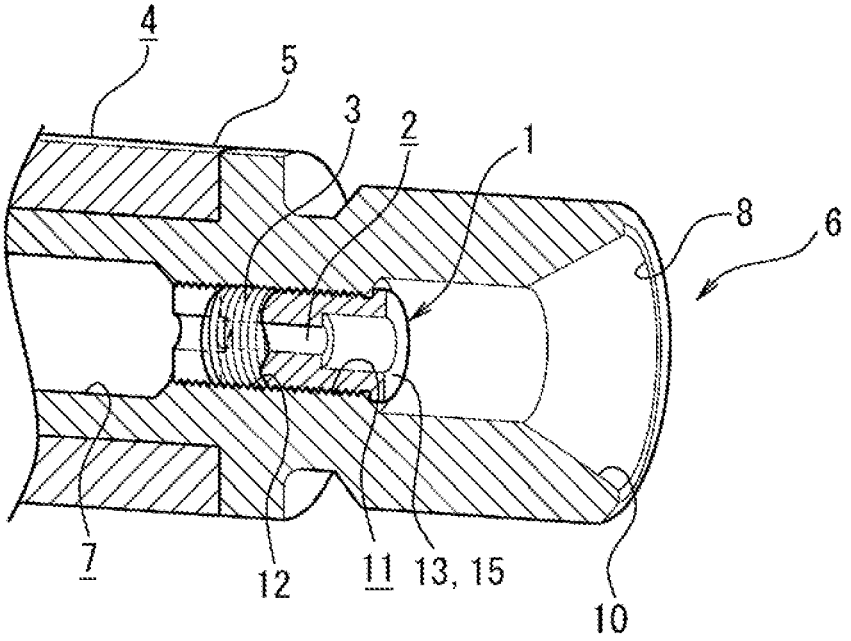
FIG. 6 is a partially enlarged cross-sectional view of another embodiment after an orifice member is attached to an inlet part.

A screw stopper (13) that does not form the inner circumferential thread (12) is provided on the communication passage (7) side of the attachment hole (11) of the inlet part (6). Therefore, when screw-fixing the orifice member (1) to the inlet part (6), the screwing of the orifice member (1) is stopped by the screw stopper (13), thus making it possible to smoothly carry out the work without worrying about where to stop screwing at the time of attaching the orifice member (1). While the screw stopper (13) as described above is provided in Embodiment 1, it is also possible in other embodiments that, as shown in FIGS. 3 and 4, an inner circumferential step (14) is provided on the inner circumference on the communication passage (7) side of the attachment hole (11) to cause the inner circumferential step (14) to serve as the screw stopper (13), and as shown in FIGS. 5 and 6, an outer circumferential projection (15) is provided on the outer circumference at one end of the orifice member (1) to cause the outer circumferential projection (15) to serve as the screw stopper (13).

Since the orifice member (1) is formed of a stainless material as described above, it is not necessary to perform plating treatment on the orifice member (1). Therefore, the problem of conventional art that a plating solution is unlikely to flow in and flow out when performing plating treatment on the orifice (2) does not arise. Since the rail body (4) and the inlet part (6) are made of steel, products can be obtained that are available in a wide variety of strengths and have superior mechanical properties to stainless materials for high-pressure systems of the future.

DESCRIPTION OF THE REFERENCE NUMERALS

1 Orifice member
4 Rail body
5 First end
6 Inlet part
7 Communication passage

The invention claimed is:

1. A gasoline direct injection rail comprising:
a steel rail body;
an inlet part provided integrally with or separately from a first end of the rail body and comprising therein a communication passage in communication with a fuel passage of the rail body; and
a plurality of injector holders in communication with the fuel passage, wherein
the communication passage of the inlet part has an attachment hole for attaching a stainless orifice member formed separately from the rail body,
the orifice member has an outer circumferential thread,
an inner circumferential surface of the attachment hole has:
an inner circumferential thread that can be screw-fitted to the outer circumferential thread of the orifice member; and
a screw stopper that does not form the inner circumferential thread,
an inner circumferential step projected inward is not provided on the inner circumference surface of the attachment hole, and
the orifice member is screw-fixed to the communication passage.

2. A gasoline direct injection rail comprising:
a steel rail body;
an inlet part provided integrally with or separately from a first end of the rail body and comprising therein a communication passage in communication with a fuel passage of the rail body; and
a plurality of injector holders in communication with the fuel passage, wherein
the communication passage of the inlet part has an attachment hole for attaching a stainless orifice member formed separately from the rail body,
the orifice member has an outer circumferential thread, an inner circumferential surface of the attachment hole has an inner circumferential thread that can be screw-fitted to the outer circumferential thread of the orifice member, an inner circumferential step projected inward is not provided on the inner circumference surface of the attachment hole, and an outer circumferential projection is provided on an outer circumference at one end of the orifice member to cause the outer circumferential projection to serve as a screw stopper.

* * * * *